United States Patent [19]

Kusaba et al.

[11] 4,420,961

[45] Dec. 20, 1983

[54] METHOD FOR PRODUCING BEAM BLANK FOR UNIVERSAL BEAM

[75] Inventors: Yoshiaki Kusaba, Nishinomiya; Chihiro Hayashi, Takarazuka, both of Japan

[73] Assignee: Sumitomo Metal Industries, Ltd., Osaka, Japan

[21] Appl. No.: 387,202

[22] Filed: Jun. 10, 1982

[30] Foreign Application Priority Data

Jul. 10, 1981 [JP] Japan ..... 56-107940
Apr. 30, 1982 [JP] Japan ..... 57-72706

[51] Int. Cl.[3] ..... B21B 1/10

[52] U.S. Cl. ..... 72/221; 72/225; 72/234

[58] Field of Search ..... 72/221, 225, 234, 336

[56] References Cited

U.S. PATENT DOCUMENTS 4,086,801 5/1978 Nakajima et al. ..... 72/234
4,362,041 12/1982 Nakanishi et al. ..... 72/221

FOREIGN PATENT DOCUMENTS 49-114560 8/1974 Japan .
55-70402 4/1980 Japan .
55-5164 7/1980 Japan .
56-95402 11/1981 Japan .
56-41002 3/1981 Japan .

*Primary Examiner*—Francis S. Husar
*Assistant Examiner*—Jorji M. Griffin
*Attorney, Agent, or Firm*—Burns, Doane, Swecker & Mathis

[57] ABSTRACT

A rough rolling process for forming a beam blank for a universal beam from a flat slab, comprises the steps of making a triangular slit of a predetermined apical angle in each of longitudinal side edges of said flat slab and gradually deepening said slit with the apical angle thereof fixed; and widening the slit after the depth of said slit has reached a predetermined value.

4 Claims, 16 Drawing Figures

METHOD FOR PRODUCING BEAM BLANK FOR UNIVERSAL BEAM

BACKGROUND OF THE INVENTION

The present invention relates to a method for producing a beam blank for a universal beam from a flat slab using a breakdown mill incorporated in a universal beam rolling line.

Heretofore, a universal beam was produced by heating a beam blank bloomed from a steel ingot and by rolling it by a universal mill. Recently, however, in view of saving energy and increasing yield rate, a method for rolling the universal beam directly from a continuous-cast slab is becoming widely practised.

Since a continuous-cast slab generally has a less thickness than a steel ingot, it was impossible to form a beam blank having a large flange width from the continuous-cast slab by a conventional caliber rolling process. In order to overcome this disadvantage, accordingly, various new rolling methods have been proposed, some representative examples of which will be briefly described below.

In the first method disclosed by Japanese Patent Public Disclosure No. 70402/80 Official Gazette, a breakdown mill having a number of box calibers with gradually increased groove bottom widths is used to roll a slab with the widthwise direction thereof in the vertical direction, changing the calibers sequentially to reduce the width of the slab into a so-called dog-bone shape and, thereafter, the dog-bone shaped material is rolled into a beam blank of a predetermined shape by a sizing caliber. This method requires a number of box calibers. In general, it is difficult to form a beam blank for a large size universal beam using only a single breakdown mill because of a limitation in length of the roll barrel.

In the second method disclosed by Japanese Patent Public Disclosure No. 41002/81 Official Gazette, a projection is provided at the center of the first box caliber to thereby form a concave groove at the center in the direction of the thickness of the slab, the material is rolled in the next caliber to reduce its width while being held by a similar projection therein so as not to fall down, into a so-called dog-bone shape, thereafter the concavity of the material is eliminated by a box caliber having a normal flat groove bottom, and the material is formed into a beam blank of a predetermined shape by a sizing caliber.

In the third method disclosed by Japanese Patent Public Disclosure No. 5164/80 Official Gazette, a slab is bitten directly by a universal mill and formed into a beam blank of a predetermined shape. In the universal mill, large widthwise reduction is impossible in earlier passes because vertical rolls are generally undriven.

In the fourth method disclosed by U.S. Pat. No. 4,086,801, portions constituting flanges are widened by a plurality of box calibers each having a bulge at the center of the bottom thereof and the apical angles of the bulges being different from each other. In this method, at the time when the material is bitten into the next caliber, the difference in the apical angle between the material and the caliber makes it difficult that the material is bitten from the tip ends of the flange constituting portions and widened equally in both the sides. Accordingly, the material may probably be twisted.

Other incidental steps are, for example, a method disclosed by Japanese Patent Public Disclosure No. 114560/79 Official Gazette, in which a box caliber is used again after a forming caliber, and a method disclosed by Japanese Patent Public Disclosure No. 95402/81 Official Gazette, in which a crowned box caliber is used.

Each of the conventional methods described above utilizes so-called dog-bone deformation in which a slab smaller in thickness than the heretofore used steel ingot is reduced to a large extent in the widthwise direction in such a manner that the reduction force does not effect the central portion of the slab which is expanded only in the ends, into the so-called dog-bone shape. Particularly, in the case of a wide flange universal beam, a total rolling reduction in the width of 500 mm or more is required.

In these prior art methods, the large widthwise reduction produces very large fish-tail in both ends of the beam blank, resulting in a large quantity of crop to be cut off, thereby leading to a decrease in the yield rate of the rolling operation. Further, the necessity for a large number of passes for widthwise reduction sharply reduces the rolling efficiency. The increase in the number of passes causes inevitably a fail in the temperature of the slab and necessitates inclusion of an additional step of cutting the beam blank to the length suitable for charging into a heating furnace and reheating it, between the step of producing the beam blank and the step of making the universal beam from said beam blank.

In the case where a slab having a large flatness ratio is set up with the widthwise direction thereof in the vertical direction and is rolled in the vertical direction, the slab is liable to fall down and to thereby produce a rolling defect which often remains in the product.

SUMMARY OF THE INVENTION

An object of the present invention is to provide a method for producing a beam blank for a universal beam, capable of increasing the yield rate and efficiency of the rolling and improving the quality of the product by using a flat slab such as a continuous-cast slab.

The basic method of the present invention is, in a process for forming a beam blank for a universal beam from a flat slab, a method comprising the steps of making a triangular slit of a predetermined apical angle in each of longitudinal side edges of said flat slab and gradually increasing the depth of the slit with the apical angle of said slit fixed after the depth of said slit has reached a predetermined value.

The step for gradually increasing the depth of the slit is performed by providing a pair of reduction rolls of the breakdown mill with a plurality of box calibers, providing the calibers in the bottoms thereof with triangular projections having the same predetermined apical angle and the heights gradually increasing from one to the next, and passing the flat slab through the calibers sequentially.

In the step of making a slit and then gradually deepening the slit, it is desired that the material is not subjected to substantial reduction at the tip ends on opposite sides of the slit by the bottom of the caliber, because the method according to the present invention is different in the basic conception from the conventional method in which the slab is subjected to strong reduction at both the ends thereof to produce a thicknesswise expansion (so-called dog-bone deformation) there. That is, in the method according to the present invention, as described hereinabove, the dog-bone shape is formed by making a slit of a predetermined depth and then widening the slit. In order to obtain the required depth of the slit with as few pass times as possible, accordingly, it is desired that the material is allowed to extend freely at the tip ends on both the sides of the slit, without being reduced by the bottom of the caliber.

It is further desired in the step of deepening the slit that, at least in one pass, the material is constrained at the tip ends on both sides thereof by the sides of the caliber to prevent the thicknesswise expansion (so-called dog-bone deformation) thereof. By doing so, the outward extension of the material in the widthwise direction of the slab is promoted to thereby facilitate the making of the slit of the predetermined depth.

The step of widening the slit is performed by the breakdown mill or the universal roughing mill. The reduction roll of the breakdown mill is provided with flat-bottomed box calibers whereby the slitted slab is rolled on the slitted side edges.

In the case of producing a beam blank using the breakdown mill, it is possible to produce a wide range of differently sized and shaped beam blanks for universal beams from the same breakdown rolls with, besides box calibers for forming slit, a plurality of flat-bottom box calibers having different bottom widths and a forming caliber having a predetermined width for reducing the web thickness, widening the slit of the slab using some of said flat-bottomed box calibers, rolling said slab using the forming caliber to adjust the web thickness to a predetermined value, and rolling said slab using again said flat-bottomed box calibers to adjust the web height.

In the method according to the present invention, the yield rate is increased since a large fish tail is not produced in any ends of the beam blank, the rolling efficiency is increased by the reduction in the number of the rolling passes since the flange width increasing efficiency is high, and even a large product can be produced by only a single heat since the thickness of the starting flat slab can be smaller.

In the method according to the present invention, it is made possible to roll universal beams of 30 or more different sizes in 10 series by only a pair of reduction rolls. In other words, only three kinds of reduction rolls are sufficient to roll products of all the JIS sizes, to thereby reduce about 90% of 25 kinds or 50 sets of the heretofore required reduction rolls.

BRIEF DESCRIPTION OF THE DRAWINGS

The invention will be better understood from the following description taken in connection with the accompanying drawings in which.

DESCRIPTION OF THE PREFERRED EMBODIMENTS

Figure 1A:
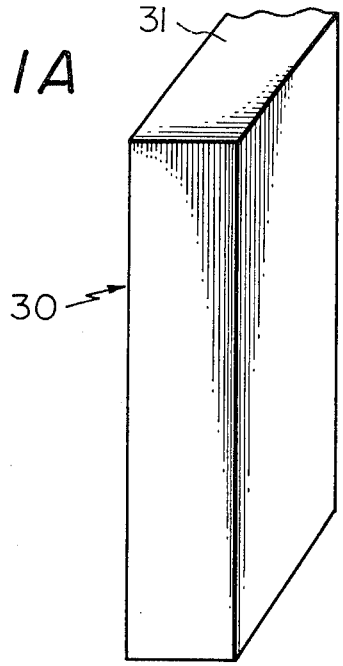
FIGS. 1A to 1D are schematic illustrations of the steps of the method according to the present invention.

In the method according to the present invention, a flat slab 30 (hereinafter called material, see FIG. 1A) obtained by continuous casting or any other processes is first heated in a heating furnace to a temperature of 1200° C. or higher. Then, the material 30 is formed in each of its longitudinal side edges 31 a slit 32 of a predetermined shape (FIG. 1B).

The forming of the slits 32 is carried out in a reversible 2-high breakdown mill (hereinafter called BD mill) by rough rolling of the material 30 with its widthwise direction vertically by a pair of reduction rolls 1 having a plurality of box calibers K1, K2, K3 . . . of predetermined shapes shown in FIG. 2. The box calibers K1, K2, K3 . . . each has a triangular projection 2 having a predetermined height h and a predetermined apical angle $\theta$. The triangular projections 2 of the box calibers K1, K2, K3 . . . are designed to have the substantially fixed apical angles $\theta$ and the gradually increasing heights h.

Figure 1B:
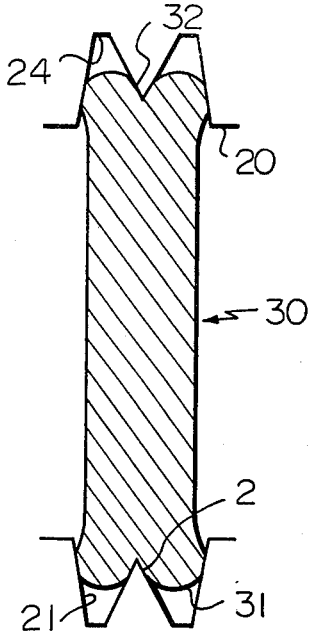
Figure 1C:
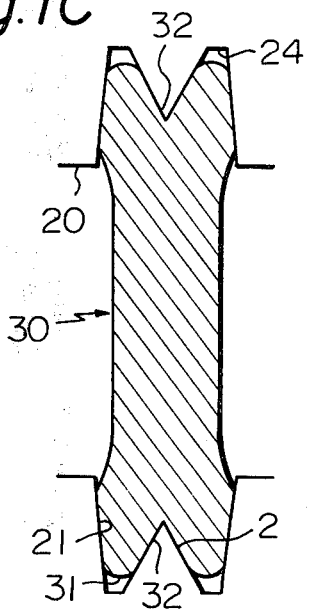
Figure 1D:
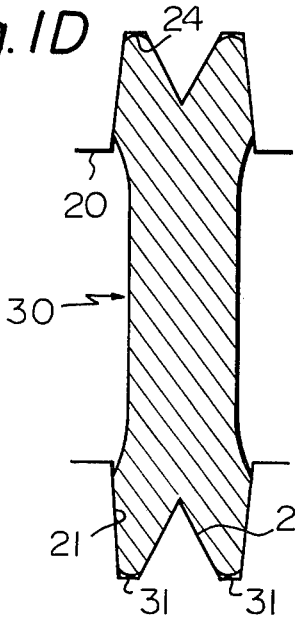

Using the above-described box calibers, K1, K2, K3 . . . , the depth d of the slit 32 of the material 30 is increased gradually to the predetermined value (FIG. 1B–1D).

Then, by the BD mill or the universal roughing mill (hereinafter UR mill), the slit 32 of the material 30 is widened to obtain a beam blank 40 of a predetermined shape.

Figure 3A:
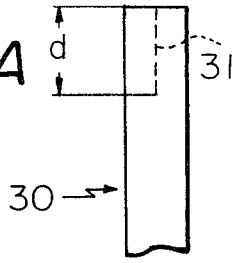
FIGS. 3A and 3B are partial cross-sectional views of the material showing the relationship between the slit depth of side edges of a flat slab and the flange width of the product.
Figure 3B:
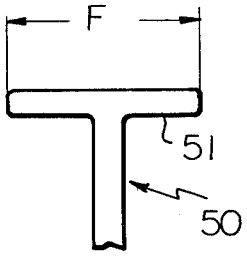

FIGS. 3A and 3B show the relationship between the final depth d of the slit 32 formed in the material 30 and the width F of the flange 51 of the universal beam 50 produced. There is an interrelation between the depth d and the flange width F, and the ratio thereof is determined by the kind of the mill used in the step of widening the slit 32.

In the case where the slit widening step is carried out by the flat-bottomed box caliber of the BD mill (FIG. 4), the widening efficiency is lower than that by the UR mill (FIG. 5) since the slit is somewhat compressed vertically while being widened horizontally. Accordingly, the depth d of the slit is preferably 40% or more of the flange width F of the product.

On the other hand, in the case where the slit widening step is carried out by the UR mill (FIG. 5), the degree of compression of the slit is small since the web also is reduced by vertical roll 4 while the slit is widened by horizontal roll 3. Accordingly, the slit depth d can be smaller than 40% of the flange width F of the product.

Figure 4:
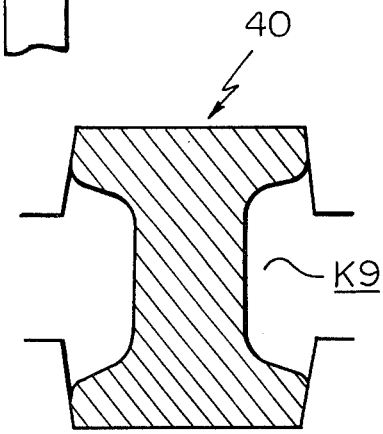
FIG. 4 is an illustration of the state in which the slit formed in the slab is widened by the breakdown mill.
Figure 5:
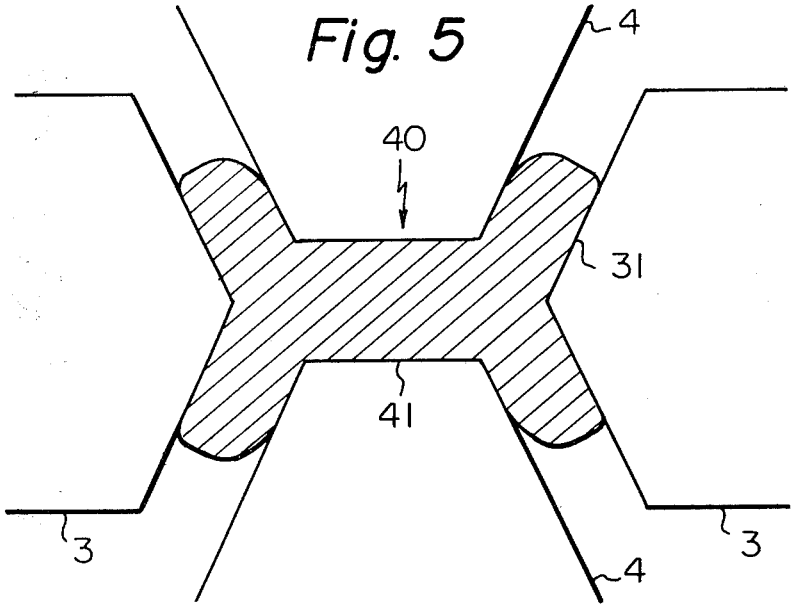
FIG. 5 is an illustration of the state in which the slit formed in the slab is widened by the universal roughing mill.

FIGS. 4 and 5 show the step of, after the slit 32 of the predetermined depth is formed, widening the slit 32 to form the beam blank 40. Particularly, FIG. 4 shows the case in which the slit widening step is carried out by the flat-bottomed caliber K9 and FIG. 5 shows the case in which the slit widening step is carried out by the vertical roll 3 of the UR mill.

In the case where the UR mill is used, the web of the beam blank 40 can be reduced by the horizontal roll 4 while the slit 32 is widened by the vertical roll 31.

The preferred mode of the step of forming the slit 32 on the side edge 31 of the slab will now be described.

Figure 7:
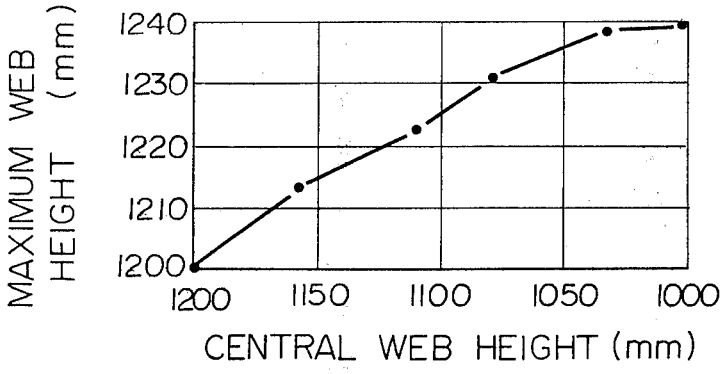
FIG. 7 is a graphical representation of the experimental results obtained by using the knifing caliber of FIG. 6.
Figure 6:
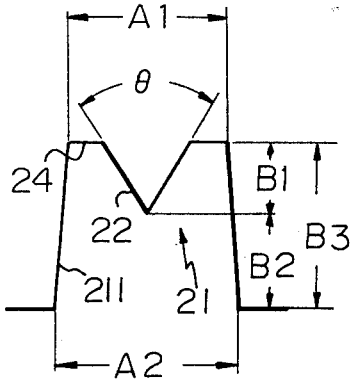
FIG. 6 is a partial front view of an experimental knifing caliber, illustrative of a preferred mode of forming the slit by the method according to the present invention.

FIG. 7 shows the change of the maximum web height in the case where the material having the size, thickness t=300 mm, and width H=1200 mm, was reduced by 200 mm in the widthwise direction using the knifing caliber 21 having the size shown in FIG. 6 which are:

| | |
|---|---|
| A1 = 290 mm, | A2 = 315 mm, |
| B1 = 125 mm, | B2 = 145 mm, |
| B3 = 270 mm, | $\theta$ = 60° |

Figure 8:
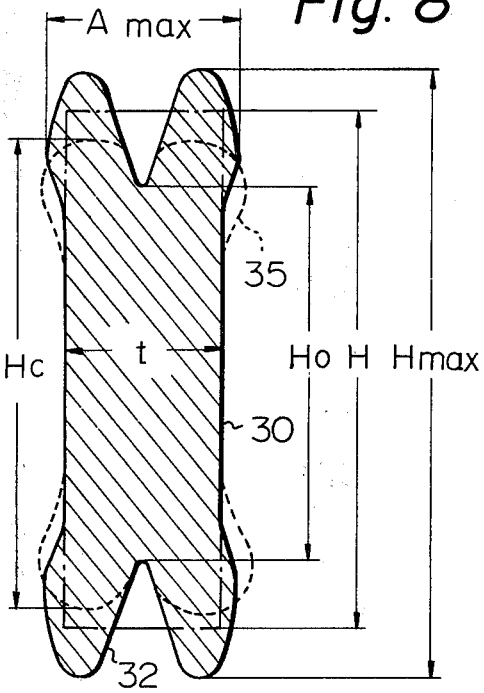
FIG. 8 is an illustration of deformation of the material in the experiment using the knifing caliber of FIG. 6.

In FIG. 7, the maximum web height Hmax denotes the maximum height of the material 30 having the slits formed therein as shown FIG. 8, and the central web height Ho denotes the distance between the slit bottoms of the material 30 as shown in FIG. 8.

In the reduction to make the slits, as seen from FIGS. 1B to 1D and FIG. 6, the material 30 flows toward the bottom of the caliber since the material is constrained on both side edges by the side walls 211 of the caliber. In the rolling free from the constraint by the side walls 211, the material is pulled down on both side edges by reduction as shown by dashed line 35 in FIG. 8, to make the maximum web height at that time Hc smaller than the initial slab width H.

However, in the case where the caliber constraining the widening of the slab ends in the thickness direction and having deep caliber bottom 24 as shown in FIG. 6 is used, the maximum web height Hmax is larger than the initial slab width H as shown by solid line in FIG. 8. In other words, the slit depth Hmax-Ho/2 is larger than the rolling reduction H-Ho/2.

This means that only a small reduction by the knifing caliber is required to obtain a given flange width and, therefore, this is considerably significant to shorten the length of the processes and to reduce the size of the material required therefor.

Figure 2:
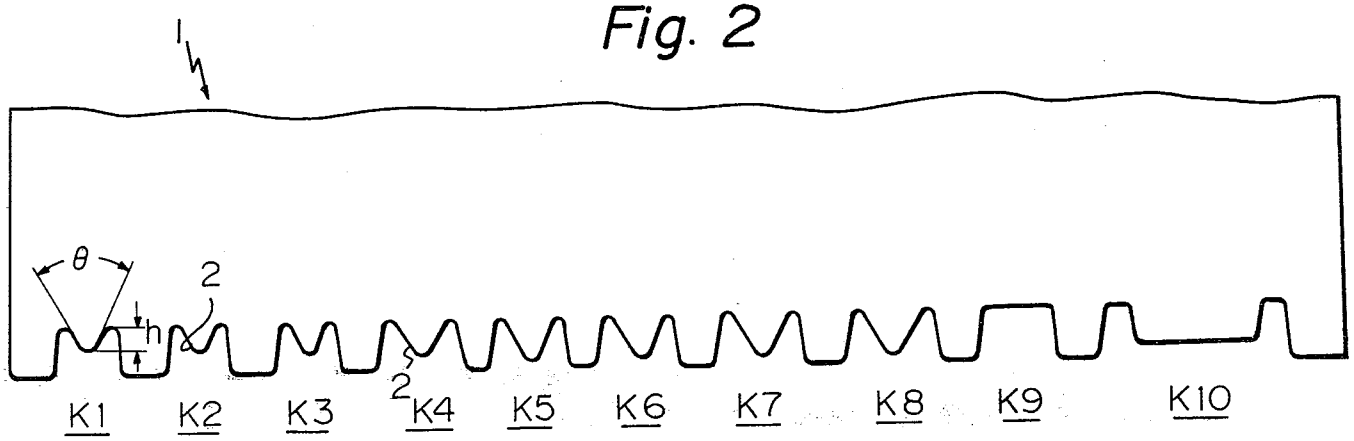
FIG. 2 is a front view of knifing calibers of a reduction roll of a breakdown mill used in the method according to the present invention.
Figure 9B:
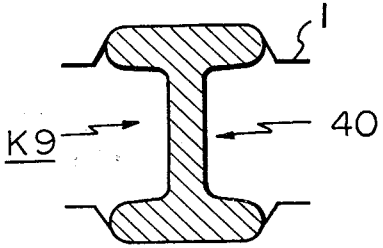
FIGS. 9A and 9B are front views showing steps of forming the universal beam from the beam blank produced by the method according to the present invention.
Figure 9A:
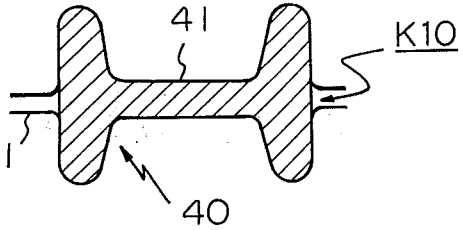

The beam blank 40 obtained in this way is reduced in thickness of the web portion 41 and shaped in the entire sectional form by the forming caliber K10 (FIG. 9A) and the box caliber K9 (FIG. 9B) provided in the same reduction rolls 1 (FIG. 2).

Examples of practice of the method according to the present invention will now be described.

EXAMPLE 1

Figure 10:
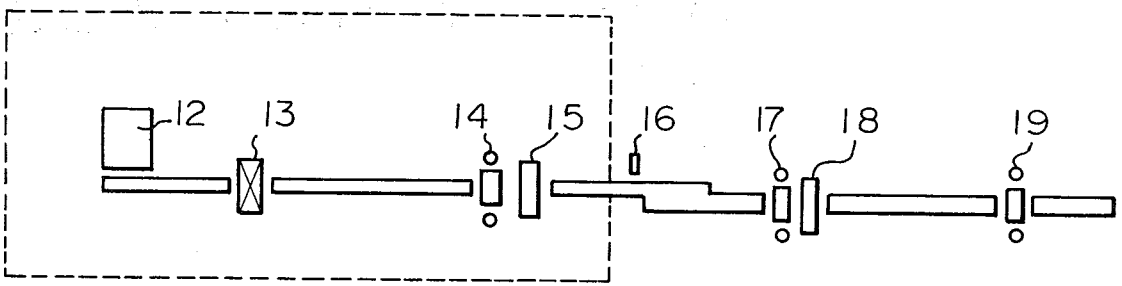
FIG. 10 is a plan view of a mill for carrying out the method according to the present invention.

The mill by which the method according to the present invention was practised had the layout shown in FIG. 10, comprising a heating furnace 12, a BD mill 13, a 1st UR mill 14, a 1st E mill (edger mill) 15, a crop saw 16, a 2nd UR mill 17, a 2nd E mill 18, and a UF mill (universal finishing mill) 19. A block 10 enclosed by a dashed line is the production line for the beam blank 40.

Figure 11:
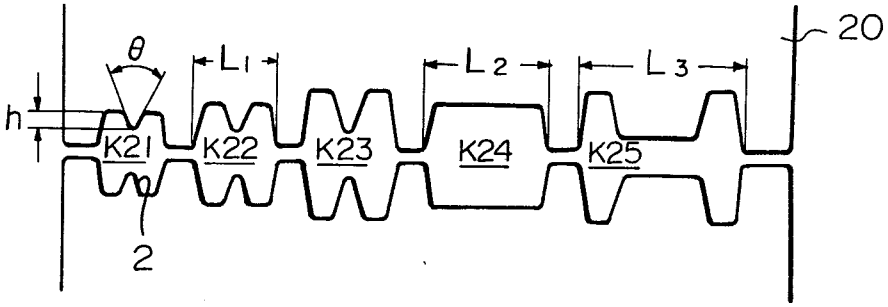
FIG. 11 is a front view of calibers used in the method according to the present invention.

To obtain a product of the size H 400 mm×400 mm, a continuous-cast slab of the size 180 mm thick×1200 mm wide was heated in the heating furnace 12 to 1250° C. and rough-rolled by a reduction roll 20 of the BD mill 13 having three kinds of knifing calibers K21–K23, a box caliber K24, and a forming caliber K25 as shown in FIG. 11. The knifing calibers K21, K22 and K16 had bottom width L1 of 220, 300 and 380 mm, respectively, the height h of the triangular projections of 40, 120 and 200 mm, respectively, and the apical angle $\theta$ of 60°. The box caliber K24 had bottom width L2 of 500 mm and the forming caliber K25 had bottom width L3 of 720 mm.

In the rough rolling, the heated slab was rolled with its widthwise direction vertically by the knifing calibers K21–K23 in two passes per caliber to be reduced by 400 mm in total and successively rolled by the box caliber K24 in three passes to widen the slit into the beam blank of a dog-bone shaped section of the web height 700 mm and the flange width 520 mm. Then, the material was turned by 90° and rolled by the forming caliber K25 in two passes into the beam blank 40 having the web thickness of 70 mm, flange width of 450 mm, and web height of 720 mm.

The beam blank 40 was then finished into the product by the crop saw 16, the 2nd UR mill, the 2nd E mill, and the UF mill 19.

The pass schedule described above is shown in Table 1.

TABLE 1

| Pass No. | Caliber No. | Web Thickness t (mm) | Reduction Draft Δt (mm) | Center Web Depth Ho (mm) | Maximum Web Depth Hmax (mm) |
|---|---|---|---|---|---|
| | | 180 | | 1200 | 1200 |
| 1 | Ⓣ K21 | " | 50 | 1150 | 1190 |
| 2 | " | " | 50 | 1100 | 1178 |
| 3 | K22 | " | 60 | 1040 | 1170 |
| 4 | " | " | 80 | 960 | 1162 |
| 5 | K23 | " | " | 880 | 1150 |
| 6 | " | " | " | 800 | 1140 |
| 7 | K24 | " | (160) | 760 | 980 |
| 8 | " | " | (160) | 720 | 820 |
| 9 | " | " | (120) | 700 | 700 |
| 10 | Ⓣ K25 | 120 | 60 | 720 | 720 |
| 11 | Ⓣ K24 | " | 20 | 700 | 700 |
| 12 | Ⓣ K25 | 70 | 50 | 720 | 720 |
| 13 | " | " | 0 | " | " |

Ⓣ : to turn the material at 90°

EXAMPLE 2

A beam blank for a universal-beam of the same size as in Example 1 (H400×400 mm) was produced by the BD mill having the roll 20 of FIG. 11.

The starting slab having the size of 1150 mm wide and 250 mm thick was heated to 1250° C. in the heating furnace 2 and then rough-rolled by the BD mill 13 having the knifing calibers K21, K22, and K23, the flat-bottomed box caliber K24, and the forming caliber K25. The knifing calibers K21, K22 and K23 had almost the same width L1 of 305, 305 and 310 mm, respectively, the height h of the triangular projection 22 of 120, 180 and 220 mm, respectively, and the apical angle $\theta$ of 60°. The box caliber K24 had the bottom width of 540 mm and the collar width L2 of 580 mm, and the forming caliber K25 had the width L3 of 720 mm.

The pass schedule of the rough rolling by the BD mill 13 is shown in Table 2.

TABLE 2

| Pass No. | Caliber No. | Web Thickness t (mm) | Reduction Draft Δt (mm) | Center Web Depth Ho (mm) | Maximum Web Depth Hmax (mm) |
|---|---|---|---|---|---|
| | | 250 | | 1150 | 1150 |
| 1 | Ⓣ K21 | " | 70 | 1080 | 1142 |
| 2 | " | " | " | 1010 | 1130 |
| 3 | K22 | " | " | 940 | 1144 |
| 4 | " | " | " | 870 | 1154 |

TABLE 2-continued

| Pass No. | Caliber No. | Web Thickness t (mm) | Reduction Draft Δt (mm) | Center Web Depth Ho (mm) | Maximum Web Depth Hmax (mm) |
|---|---|---|---|---|---|
| 5 | K23 | " | " | 800 | 1160 |
| 6 | K24 | " | (160) | | 1000 |
| 7 | " | " | (160) | | 840 |
| 8 | " | " | (140) | 700 | 700 |
| 9 | Ⓣ K25 | 200 | 50 | 720 | 720 |
| 10 | Ⓣ K24 | " | 20 | 700 | 700 |
| 11 | Ⓣ K25 | 150 | 50 | 720 | 720 |
| 12 | Ⓣ K24 | " | 20 | 700 | 700 |
| 13 | Ⓣ K25 | 110 | 40 | 720 | 720 |
| 14 | Ⓣ K24 | " | 20 | 700 | 700 |
| 15 | Ⓣ K25 | 80 | 30 | 720 | 720 |
| 16 | Ⓣ K24 | " | 20 | 700 | 700 |
| 17 | Ⓣ K25 | 70 | 10 | 720 | 720 |

Ⓣ : to turn the material at 90°

The material was rolled with its widthwise direction vertically by the knifing calibers K21, K22 and K23 in two, two and one passes, respectively, that is in five passes in total, to be reduced by 350 mm. In this case, as shown in FIGS. 1B to 1D, the tip ends 31 on the opposite sides of the slit were not in contact with the caliber bottoms 24.

Successively, the material was rolled by the box caliber K24 in three passes to be enlarged in the slits 32 into the beam blank 40 of a dog-bone shaped section as shown in FIG. 4 of the web height (Ho=Hmax) 700 mm and the flange width (Amax) 560 mm.

In the passes of the knifing caliber K22, as seen from Table 2, since the caliber width was not increased with respect to the width of the caliber K21 to constrain the thicknesswise expansion of the material, the maximum web height Hmax was increased while the center web height Ho was reduced by 80 mm. Further, only eight passes, exceedingly fewer than in prior art methods, were required to form the flat slab into the dog-bone shaped beam having the flange width which is twice or more the thickness of the flat slab.

In comparison of the results of Example 2 with those of Example 1, it is clear that Example 2 required a smaller number of passes to obtain the predetermined slit depth and smaller width (1150 mm) of the starting slab than in Example 1.

Thereafter, the material was turned by 90° (as shown by the mark Ⓣ in Table 2) and rolled by the forming caliber K25 into the beam blank 40 having the web thickness of 70 mm, flange width of 450 mm, and the web height of 720 mm.

The beam blank 40 thus produced was then cut off in the crops at both the ends by the crop saw 16 and finished into the product by the UR mill 14, the E mill 15, and the UF mill 19.

EXAMPLE 3

The slit of a beam blank for a universal-beam (H400×400 mm) was widened by the vertical roll of the universal mill. The starting material was a flat slab having the size 250 mm thick×1150 mm wide. The roll calibers of the BD mill were the same as those of Example 2. The horizontal roll and the vertical roll of the universal mill had a taper of 30°, and the vertical roll had an apical angle of 120°.

The starting flat slab was first heated to 1250° C. in the heating furnace and was formed on both side edges with a slit having the depth of 120 mm by the BD mill using the calibers K21, K22 and K23 as in Example 2. The pass schedule was the same as in Example 2 using 5 passes.

The slitted slab was transferred to the 1st UR mill to reduce the web in seven passes and at the same time the slit was widened from 60° to 120° by the vertical roll. At this time, the finishing size by the 1st UR mill was the web thickness (t) of 70 mm, the central web height (Ho) of 700 mm, and the flange width of 460 mm.

Then, the material was directed into the group of the 2nd UR mill and the 2nd E mill. The rolls of the 2nd UR mill and the 2nd E mill had a taper of 5° and the vertical roll had the apical angle of 170°. Here, the material was reduced by reverse rolling in seven passes to the size of the web thickness (t) of 13.5 mm, the flange thickness of 21.9 mm, and the flange width of 403 mm.

Lastly, the material was rolled in one pass to H400×400 mm.

The pass schedule of the BD mill and the 1st UR mill (30° taper) in Example 3 is shown in Table 3.

TABLE 3

| Mill | Pass No. | Caliber No. | Web Thickness t (mm) | Reduction Draft Δt (mm) | Central Web Depth Ho (mm) | Maximum Web Depth Hmax (mm) |
|---|---|---|---|---|---|---|
| BD | | | 250 | | 1150 | 1150 |
| | 1 | Ⓣ K21 | " | 70 | 1080 | 1142 |
| | 2 | " | " | " | 1010 | 1130 |
| | 3 | K22 | " | " | 940 | 1144 |
| | 4 | " | " | " | 870 | 1154 |
| | 5 | K23 | " | " | 800 | 1160 |
| 1st UR | 1 | | 220 | 30 | 792 | 1100 |
| | 2 | | 190 | 30 | 780 | 1040 |
| | 3 | | 160 | 30 | 770 | 1010 |
| | 4 | | 135 | 25 | 760 | 990 |
| | 5 | | 110 | 25 | 740 | 970 |
| | 6 | | 90 | 20 | 720 | 950 |
| | 7 | | 70 | 20 | 700 | 930 |

Ⓣ : to turn the material at 90°

In the method heretofore used, the beam blank was once cooled, had crops cut off and flaws treated and then had to be reheated for the processes by the UR and other mills into the final product. In the method according to the present invention, however, it is possible to roll a product with least rolling defect by only a single heat. Further, since a large fish-tail is not resulted in any ends of the beam blank the yield rate is increased, and since the flange widening efficiency is high the rolling efficiency is increased by the reduction in the number of the rolling passes thereby making it possible to make a large universal beam from a flat slab having a small thickness.

In the method according to the present invention, the rolling yield rate is increased by approximately six percent from prior art methods in which, for example, a great number of box calibers are used to produce the desired beam blank, or a projection is provided at the center of the bottom of each of the box calibers so that the material is reduced in width while held by said projection from falling down.

Since the method according to the present invention provides a high flange widening efficiency, a slab of smaller width and thickness than in the prior art methods can be used to manufacture the product of a given size. Accordingly, the slab heating temperature can be lower and this, coupled with the unnecessity for the reheating, provides a large effect in saving energy.

While we have described and illustrated the present preferred method of practising the invention, it is to be distinctly understood that the invention is not limited thereto but may be otherwise variously practised within the scope of the following claims.

What is claimed is:

1. A method for producing a beam blank for a universal beam, comprising the steps of:

making a slit longitudinally of a flat slab in each of both the side edges thereof by hot rolling using a plurality of pairs of knifing calibers each having a triangular projection at the center of the bottom thereof, said triangular projections having the same predetermined apical angles and heights gradually increasing sequentially;

gradually deepening the slit; and gradually widening the slit after the depth of the slit has reached a predetermined value, wherein during the steps of making the slit and deepening the slit, tip ends of the material on both sides of the slit are substantially free from reduction caused by the bottom of the caliber.

2. A method as set forth in claim 1, characterized in that, during at least one pass of the step of deepening the slit, the tip ends of the material on both sides thereof are constrained by the sides of the caliber to prevent the thicknesswise expansion of the material.

3. A method as set forth in claim 1 or 2, characterized in that the step of widening the slit is performed by flat-bottomed box calibers of a breakdown mill.

4. A method as set forth in claim 1 or 2, characterized in that the step of widening the slit is performed by vertical rolls of a universal mill.

* * * * *